US006165937A

United States Patent [19]

Puckett et al.

[11] Patent Number: 6,165,937

[45] Date of Patent: Dec. 26, 2000

[54] THERMAL PAPER WITH A NEAR INFRARED RADIATION SCANNABLE DATA IMAGE

[75] Inventors: Richard D. Puckett; Yaoping Tan, both of Miamisburg; Maurice W. Lewis, Dayton, all of Ohio

[73] Assignee: NCR Corporation, Dayton, Ohio

[21] Appl. No.: 09/163,411

[22] Filed: Sep. 30, 1998

[51] Int. Cl.[7] ..... B41M 5/30

[52] U.S. Cl. ..... 503/201; 503/206

[58] Field of Search ..... 503/206, 200, 503/226, 207, 201

[56] References Cited

U.S. PATENT DOCUMENTS

| | | | |
|---|---|---|---|
| 4,150,997 | 4/1979 | Hayes | 106/15.05 |
| 4,153,593 | 5/1979 | Zabiak et al. | 260/29.6 ME |
| 4,288,701 | 9/1981 | Hill | 250/569 |
| 4,328,332 | 5/1982 | Hayes et al. | 528/296 |
| 4,370,370 | 1/1983 | Iwata et al. | 428/40 |
| 4,388,362 | 6/1983 | Iwata et al. | 428/211 |
| 4,424,245 | 1/1984 | Maruta et al. | 428/40 |
| 4,444,819 | 4/1984 | Maruta et al. | 503/209 |
| 4,507,669 | 3/1985 | Sakamoto et al. | 503/207 |
| 4,551,738 | 11/1985 | Maruta et al. | 503/200 |
| 4,598,205 | 7/1986 | Kaule et al. | 250/458.1 |
| 4,682,194 | 7/1987 | Usami et al. | 503/215 |
| 4,722,921 | 2/1988 | Kiritani et a. | 503/207 |
| 4,742,043 | 5/1988 | Tanaka et al. | 503/213 |
| 4,783,493 | 11/1988 | Motegi et al. | 524/13 |
| 4,942,150 | 7/1990 | Usami et al. | 503/213 |
| 5,008,238 | 4/1991 | Gotoh et al. | 503/217 |
| 5,106,998 | 4/1992 | Tanaka et al. | 549/331 |
| 5,155,230 | 10/1992 | Hibino et al. | 548/409 |
| 5,177,218 | 1/1993 | Fischer et al. | 549/25 |
| 5,206,395 | 4/1993 | Fischer et al. | 552/201 |
| 5,250,493 | 10/1993 | Ueda et al. | 503/220 |
| 5,266,447 | 11/1993 | Takahashi | 430/345 |
| 5,292,855 | 3/1994 | Krutak et al. | 528/289 |
| 5,336,714 | 8/1994 | Krutak et al. | 524/608 |
| 5,384,077 | 1/1995 | Knowles | 252/586 |
| 5,397,819 | 3/1995 | Krutak et al. | 524/88 |
| 5,405,958 | 4/1995 | VanGemert | 544/71 |
| 5,423,423 | 6/1995 | Sato et al. | 206/387.1 |
| 5,429,774 | 7/1995 | Kumar | 252/586 |
| 5,446,151 | 8/1995 | Rickwood et al. | 544/71 |
| 5,461,136 | 10/1995 | Krutak et al. | 528/289 |
| 5,503,904 | 4/1996 | Yoshinaga et al. | 428/195 |
| 5,614,008 | 3/1997 | Escano et al. | 106/23 D |
| 5,665,151 | 9/1997 | Escano et al. | 106/31.15 |
| 5,682,103 | 10/1997 | Burrell | 106/31.15 |
| 5,703,229 | 12/1997 | Krutak et al. | 540/140 |
| 5,728,832 | 3/1998 | Wariishi | 544/249 |

FOREIGN PATENT DOCUMENTS

| | | |
|---|---|---|
| 9732733 | 9/1997 | WIPO . |

*Primary Examiner*—Bruce H. Hess
*Attorney, Agent, or Firm*—Millen White Zelano & Branigan PC

[57] ABSTRACT

Thermal paper having a near infrared radiation scannable data image comprised of near infrared flourescent compounds provides scannable data invisible to the naked eye with little interference from printed text or images on the thermal paper. The near infrared fluorescent pigments are protected from contact with oxygen using a polymer resin. Thermal papers with overlapping bar codes can be prepared when using two or more near infrared radiation scannable bar codes that respond to different wavelengths. The overlapping bar codes provide more information in a given area.

19 Claims, No Drawings

THERMAL PAPER WITH A NEAR INFRARED RADIATION SCANNABLE DATA IMAGE

FIELD OF THE INVENTION

The present invention relates to thermal paper with a near infrared radiation scannable data image such as a bar code which is not visible to the naked eye. The near infrared radiation scannable data image can be used to provide secure information to thwart counterfeiting of commercial documents on thermal paper such as labels and sales transaction records and receipts. These near infrared radiation scannable data images can be used to provide additional information by overlapping bar codes in the same area on the thermal paper.

BACKGROUND OF THE INVENTION

The formation of scannable data images on thermal paper is well known. Conventional thermal papers which employ dark inks which reflect and absorb light in the visible spectrum can form images that can be scanned with light in the visible spectrum. Common scannable data images are bar codes which contain strong visible light absorbing pigments or dyes on a white or other light reflecting background and are visible to the naked eye. One disadvantage is that they can be easily duplicated by simply photocopying an original commercial document.

The use of special inks such as fluorescent inks and other optically variable inks to form latent images which are invisible to the naked eye and not reproducible by photocopying is also well known. These latent images are more difficult to reproduce and are typically used as security features. These optically variable inks typically contain a fluorescent compound which responds to infrared or ultraviolet light. Representative disclosures of fluorescing inks include U.S. Pat. No. 4,328,332, issued to Hayes et al. on May 4, 1982, U.S. Pat. No. 4,150,997, issued to Hayes on Apr. 24, 1979 and U.S. Pat. No. 4,153,593.

The use of near infrared fluorescent (NIRF) compounds to form invisible markings is known. For example, the use of near infrared flourescent compounds in security inks for thermal transfer printing has been disclosed in International application WO 97/32733, published Sep. 12, 1997 and Yoshinaga et al., U.S. Pat. No. 5,503,904, also disclose recorded media with invisible identification marks composed of regions of high reflectance and low reflectance in the same near infrared region. In addition, Krutak et al. describe the use of near infrared fluorescent (NIRF) compounds in polyester-based coatings, polyester-amide based coatings and ink compositions which are used for marking articles for identification/authentication purposes, in U.S. Pat. No. 5,292,855, issued Mar. 8, 1994, U.S. Pat. No. 5,423,432, issued Jun. 13, 1995, and U.S. Pat. No. 5,336,714, issued Aug. 9, 1994. Krutak et al. also disclose tagging thermoplastic containers and materials with near infrared flourescent compounds in U.S. Pat. No. 5,461,136, issued Oct. 24, 1995, U.S. Pat. No. 5,397,819, issued Mar. 14, 1995, and U.S. Pat. No. 5,703,229, issued Dec. 30, 1997. Escano et al. disclose inks containing NIRF compounds in U.S. Pat. Nos. 5,614,008 and 5,665,151.

Unlike marks used as security features, a scannable data image defines a region on print media with sufficient precision to provide machine-readable information. To accomplish this, the scannable data image must not only achieve a threshold emission such that it is sensed by a photon detector, it must achieve sufficient contrast with the surface of the print medium such that the location of the boundaries of the image on the print medium can be identified by a logic apparatus via signals from the photon detector. Security features do not require such a level of contrast with the print medium. The security marks need only be sensed for a pass/fail test. While interfering emissions or absorbance from the surface of the print medium with a security mark cannot be ignored, the location of the boundaries of the image is typically irrelevant, such as where the NIRF compound is uniformly (flood) coated on the base sheet or is incorporated in the printed matter.

A print medium commonly used in commercial transactions is thermal paper. Direct thermal paper is a thermosensitive recording material on which print or a design is obtained by the application of heat energy, without an ink ribbon. Thermal paper comprises a base sheet and a coating, and like other coated papers, the coating is applied to give new properties to the base sheet. However, a major distinction in thermal paper from other coated papers is that special color forming chemicals and additives are present in the coatings such that when heat is applied by a thermal head, the color forming chemicals react to develop the desired print or image.

The most common type of thermal coating is the dye-developing type system. The three main color producing components in a dye developing-type thermal paper are a colorless dye (color former), a bisphenol compound or an acidic material (color developer) and a sensitizer. These solid materials are reduced to very small particles by grinding and are incorporated into a coating formulation along with any optional additives such as pigments, binders and lubricants. This coating formulation is then applied to the surface of a base sheet such as paper or other support system and dried. Images are formed on the coated surfaces by the application of heat to melt and interact the three color producing components. The intensity (darkness) of the images formed by the thermal papers depends on the dyes and developers used. Certain dyes and developers can provide images which are scannable with visible light, others do not provide the intensity and thus the requisite contrast for a scannable data image. Where special features are desired for thermal paper, the additives used must not pre-react the reactive components within the thermosensitive coating of the thermal paper to detract from the thermal papers printing performance. Certain chemical factors can adversely affect and degrade the performance of the thermosensitive coating and should be avoided such as some organic solvents (ketones), plasticizers (polyethylene glycol type), amines (ammonia) and certain oils (soy oil).

To protect thermal paper from environmental conditions, and premature coloration from handling, a number of developments have been made. One is to produce a barrier or protective layer on top of the thermal coating (see U.S. Pat. Nos. 4,370,370; 4,388,362; 4,424,245; 4,444,819; 4,507,669; and 4,551,738). Another approach is to encapsulate the reactive components in microcapsules which rupture or become permeable when exposed to heat (see U.S. Pat. No. 4,682,194).

It is desirable to provide a scannable data image on thermal paper which is not visible to the naked eye and can provide secure data and/or function as a security feature.

SUMMARY OF THE INVENTION

It is an object of the present invention to provide thermal paper with a near infrared radiation scannable data image that comprises a near infrared fluorescent compound (NIRF).

It is another object of the present invention to provide thermal paper with a near infrared radiation scannable data image which comprises a near infrared fluorescent compound (NIRF) that is invisible to the naked eye.

It is an additional object of the present invention to provide thermal paper with a near infrared radiation scannable data image that encodes secure data.

It is yet a further object of the present invention to provide thermal paper with overlapping bar codes that respond to different wave lengths of radiation to provide additional scannable information in a given area.

Further objects and advantages of this invention will become apparent and further understood from the detailed description and claims which follow.

The above objects are achieved through a thermal paper which comprises at least one near infrared radiation scannable data image positioned thereon. The scannable data image comprises a near infrared flourescent (NIRF) compound which reflects light in the near infrared region when illuminated with near infrared radiation. The concentration of NIRF compounds in the scannable data image is sufficiently high to contrast the reflectance of near infrared radiation by said image from that of the base sheet to allow the boundaries of the scannable data image to be sensed when scanned by a detector operating in the near infrared region of 670 nm to 2,500 nm. Where the boundaries can be detected, the scannable data image can be read by a logic element based on signals from the detector.

In preferred embodiments, the thermal paper comprises a thermosensitive layer with a dye and developer which provides images of sufficient intensity to be scanned with visible light. The NIRF compounds (and their carriers) are selected so as not to pre-react the thermosensitive coating on the thermal papers. Preferred NIRF compounds reflect radiation at a wavelength of about 780 nm and above. These compounds experience less interference thermal paper as background.

The NIRF compounds provide a unique scannable data image through the unique wavelength of radiation to which the NIRF compounds respond. These scannable data images can be invisible to the naked eye and can be used to encode secure data and function as a security feature. The near infrared radiation scannable data images can be overlapped by other near infrared radiation scannable data images which respond to different wavelengths or they can be applied on top of or beneath conventional visible light scannable data images on thermal paper which are visible to the naked eye to provide additional data in a given area. These conventional visible light scannable data images are those formed by activating the thermosensitive coating of the thermal paper.

In another aspect of the present invention, there is provided a method of preparing a thermal paper with a near infrared radiation scannable barcode which comprises forming a uniform layer of NIRF compounds on a thermal paper and thermally activating the thermosensitive layer in the pattern of a reverse bar code. The activated thermosensitive coating comprises a near infrared radiation absorbing dye which absorbs near infrared radiation in the range of 670 nm to 2500 nm. The coatings can be applied by conventional coating processes.

DETAILED DESCRIPTION

The thermal papers suitable for use in this invention comprise a base sheet which is coated with a thermosensitive layer. Preferably, the thermal papers employed comprise a base substrate, a base coating positioned on said base substrate and a thermosensitive coating positioned on said base coating. Suitable base sheets can comprise natural or synthetic fibers or both, and are either filled or unfilled with pigments such as titanium dioxide. The base coating is typically comprised of inert clays and provides a smooth surface for the thermosensitive coating. The thermal papers may optionally also have a top coating or back coating such as protective coatings which prevent discoloration during handling. provide reactive elements that generate color upon the application of heat. Base sheets for thermal printing include those having protective layers which prevent discoloration during handling.

The thermal papers of this invention contain at least one near infrared radiation scannable data image positioned thereon and can contain multiple scannable data images. The NIRF compounds that provide the near infrared radiation scannable image can be deposited on or incorporated in the following components of a thermal paper:

a) the base substrate;
b) the base coating;
c) the thermosensitive (active) coating;
d) a separate top coating, if present;
e) a separate back coating, if present; or
f) a combination of a)-e).

The scannable data images can comprise a pattern with segments of a size sufficient for a detector operating in the near infrared region of 670 nm to 2,500 nm to detect at least two boundaries of these segments. Preferably, the segments of the scannable data image are of a size consistent with segments of conventional bar codes based on carbon black inks. The area of these segments can range from 0.125 $inch^2$ to 1.0 $in^2$. Most preferably, the segments of the scannable data image are rectangles having a length ranging from ¼ inch to 1½ inch and a width of from 1/32 inch to ½ inch. The contrast in reflecting near infrared radiation between the scannable data image and the thermal paper must be sufficiently high such that at least two boundaries of the segments can be sensed by a detector operating in the near infrared region, which allows the location of the boundaries to be determined and the data encoded by the scannable data image to be read by a logic apparatus operating on a signal from the detector. Where the detected near infrared radiation is converted to a voltage by the detector, such as a photon detector, the scannable data image preferably provides a voltage of at least 0.1 volts greater than the thermal paper background. Preferably, the voltage differential is about 0.2 volts.

The near infrared radiation scannable data image comprises a near infrared fluorescent (NIRF) compound which reflects and/or fluoresces near infrared radiation when illuminated with near infrared radiation. The concentration of NIRF compound within this scannable data image is sufficiently high to detectably contrast the reflectance of near infrared radiation by the scannable data image from the reflectance of near infrared radiation by the thermal paper. Such a concentration can be achieved with a coating formulation comprising at least 0.5 ppm NIRF compound, based on total solids, applied with a flexographic press or ink jet printer. Preferred concentrations of NIRF compounds in the scannable data images are those derived from flexographic coating printing formulations or ink jet printing coating formulations comprising 0.5 to 300 ppm NIRF compound in pigment form, based on total solids. Lower concentrations of NIRF compound can be used effectively with NIRF dyes. The concentration of NIRF compound within the NIRF dyes can range from about 0.01 ppm to 1000 ppm.

To form the near infrared radiation scannable data image, a coating formulation containing NIRF compound can be applied to the thermal paper in the pattern of a scannable data image or a mask that absorbs near infrared radiation can be applied over a uniform coating of NIRF compounds in a pattern to form a scannable data image through the exposed portions. A combination of both techniques can also be used. The near infrared radiation scannable data image can be printed on either side of the thermal paper for detection.

The thermosensitive coating is preferably of the dye-developing type. Particularly suitable dye developer systems are those wherein the reactive dyes are colorless or white-colored which become dark colored when melted and exposed to a color developer so as to provide bar code images which are scannable with a conventional bar code scanner. Such dyes are typically basic substances which become colored when oxidized by acidic compounds or bisphenol compounds. In these dye-developer systems, sensitizers are typically mixed with the dyes to form a blend with a reduced melting point. This reduces the amount of heat necessary to melt the dye and obtain reaction with the color developer. The components of the thermosensitive coating are often determined by the operating temperature of the thermal printer to be used. The operating temperature of conventional thermal printers varies widely, typically within the range of from 50° C. to 250° C. One skilled in the art can readily determine the melting point necessary for a desired application and select a dye and developer accordingly, or select a conventional thermal paper with a thermosensitive coating on one side. A well-known dye is that identified in the art as "ODB-II". A preferred color developer is bisphenol A and a preferred sensitizer is M-terphenyl.

Color formers suitable for use in the coating formulations in thermosensitive recording materials of this invention are those conventionally used in thermal papers such as leuco dyes. Leuco dyes are colorless or light-colored basic substances, which become colored when oxidized by acidic substances. Examples of leuco dyes that can be used herein are described in copending application Ser. No. 09/153,188, filed Sep. 15, 1998 entitled, "Print Media with Near Infrared Fluorescent Sense Mark and Printer Therefor" and assigned to the same assignee as the present invention. Specific examples of suitable leuco dyes include:

3,3-bis(p-dimethylaminophenyl)-phthalide, 3,3-bis(p-dimethylaminophenyl)-6-dimethylaminophthalide (Crystal Violet Lactone), 3,3-bis(p-dimethylaminophenyl)-6-diethylaminophthalide, 3,3-bis(p-dimethylaminophenyl)-6-chlorophthalide, 3,3-bis(p-dibutylaminophenyl)-phthalide, 3-cyclohexylamino-6-chlorofluoran, 3-(N-N-diethylamino)-5-methyl-7-(N,N-Dibenzylamino) fluoran, 3-dimethylamino-5,7-dimethylfluoran, 3-diethylamino-7-methylfluoran, 3-diethylamino-6-methyl-7-chlorofluoran, 3-pyrrolidino-6-methyl-7-anilinofluoran, 2-[3,6-bis(diethylamino)-9-(0-chloroanilino) xanthybenzoic acid lactam], 3-(2'-hydroxy-4'-dimethylaminophenyl)-3-(2'[-methoxy-5'-chlorophenyl)phthalide, 3-(2'-hydroxy-4'-dimethylaminophenyl)-3-(2'-methoxy-5'-nitrophenyl-phthalide, 3-(2'-hydroxy-4'-diethylaminophenyl)-3-(2'-methoxy-5'-methylphenyl)phthalide, and 3-(2'-methoxy-4'-dimethylaminophenyl)-3-(2'-hydroxy-4'-chloro-5'-methylphenyl)-phthalide.

There are many substances which change the color of the dyes by oxidizing them and function as developers. Color developers suitable for the coating formulations and thermal sensitive recording materials of this invention are phenol compounds, organic acids or metal salts thereof and hydroxybenzoic acid esters.

Preferred color developers are phenol compounds and organic acids which melt at about 50° C. to 250° C. and are sparingly soluble in water. Examples of phenol compounds include 4,4'-isopropylene-diphenol (bisphenol A), p-tert-butylphenol, 2-4-dinitrophenol, 3,4-dichlorophenol, p-phenylphenol, 4,4-cyclohexylidenediphenol. Useful examples of organic acid and metal salts thereof include 3-tert-butylsalicylic acid, 3,5-tert-butylsalicylic acid, 5-a-methylbenzylsalicylic acid and salts thereof of zinc, lead, aluminum, magnesium or nickel. Some of the color developers are 2,2,-bis(4'-hydroxyphenyl)propane (Bisphenol-A), p-phenylphenol, 2,2-bis(4'-hydroxyphenyl)-n-heptane and 4,4'-cyclohexylidene phenol.

Sensitizers or thermosensitivity promoter agents are used in the coating formulation and thermal papers of the present invention to give a good color density. The exact mechanism by which the sensitizer helps in the color forming reaction is not well known. It is generally believed that the sensitizer forms a eutectic compound with one or both of the color forming compounds. This brings down the melting point of these compounds and thus helps the color forming reaction to take place with ease at a considerably lower temperature. Some of the common sensitizers which are suitable are fatty acid amide compounds such as acetamide, stearic acid amide, linolenic acid amide, lauric acid amide, myristic acid amide, methylol compounds or the above mentioned fatty acid amides such as methylenebis (stearamide), and ethylenebis (stearamide), and compounds of p-hydroxybenzoic acid esters such as methyl p-hydroxybenzoate, n-propyl p-hydroxybenzoate, isopropyl p-hydroxybenzoate, benzyl p-hydroxybenzoate.

The thermosensitive coating compositions can be applied to any conventional base sheet or layer suitable for use in thermal paper. The base sheet or layer must not contain any reactive elements which would prematurely color the thermosensitive coating. The thermosensitive coating can vary in composition, as is conventionally known in the art, including the encapsulation of components therein and the use of protective layers thereon to prevent premature coloration during handling. Preferred thermosensitive coatings will provide bar code images of sufficient intensity to be scanned with a conventional bar code reader operating in the visible light range. The thermosensitive coatings can also be applied by conventional methods using conventional equipment.

The NIRF compounds employed in the thermal papers and methods of the present invention are responsive to wavelengths in the near infrared region of 670 nm to 2,500 nm. The NIRF compounds need not absorb or transmit visible light under ambient indoor conditions or when illuminated. Preferably, they are transparent or invisible to the naked human eye under ambient light.

Preferred NIRF compounds, used in the form of dyes or pigments, have excellent thermal stability and little light absorption in the visible light region, i.e., they impart little or no color to the coatings and substrates (thermal papers) to which they are applied. These compounds have strong absorption of near infrared light (high molar extinction coefficients, e.g., >2000), and have strong fluorescence in the near infrared region over the wavelengths of about 670 nm to 2500 nm. They are preferably stable to sunlight and fluorescent light. The NIRF pigments and dyes are also preferably soluble, dispersible or emulsifiable in water to provide "water-based" formulations. An example of a preferred NIRF pigment is NIRF 2300 from Eastman Chemical, which absorbs and reflects near infrared radiation at a wavelength of about 780 nm.

The NIRF compounds within the scannable data image are shielded from oxygen in ambient air, preferably by a polymer resin which limits contact of the NIRF compounds with air. Where a NIRF dye is used, a layer of these compounds must be overcoated with a polymer resin. The near infrared radiation scannable data image employed on thermal paper may be positioned underneath the thermosensitive coating to further shield the NIRF compounds from contact with ambient oxygen. Where NIRF pigments are used, the NIRF compounds are shielded by the polymers admixed or copolymerized therewith.

Suitable NIRF pigments and dyes include those described in U.S. Pat. Nos. 5,292,855; 5,423,432; 5,336,714; 5,461,136; 5,397,819; 5,703,229; 5,614,088; 5,665,151 and 5,503,904. The NIRF compound (pigment or dye) employed may depend on the equipment used. Preferred NIRF compounds are selected from the classes of phthalocyanines, naphthalocyanines, squaraines that correspond to formulae II, III and IV in column 6 of U.S. Pat. No. 5,703,229. These compounds can be prepared by conventional methods.

These preferred compounds of Formulae II and III have phthalocyanine (Pc) moieties and 2,3-naphthalocyanine (Nc) moieties of formulae IIa and IIIa defined in column 7 of U.S. Pat. No. 5,703,229 and the substituents are as defined in column 7, line 45 to column 9, line 14 of U.S. Pat. No. 5,703,229. More preferred NIRF compounds of formulae II and III are defined in column 9 lines 15–34 of U.S. Pat. No. 5,703,229. For formulae II and III, the phthalocyanine and 2,3-naphthalocyanine compounds of formula IIa and IIIa may also be covalently bound to a hydrogen, AlOH, Ca, CO, CrF, Cu, Fe, Ge, $Ge(OR_6)$, InCl, Ni, Ga, Mg, Mn, Pb, Pt, Pd, $SnCl_2$, Sn, $Si(OR)_2$, $Sn(OR_6)_2$, TiO, VO, Zn and others, as described in U.S. Ser. No. 789,570, filed Nov. 8, 1991, which is a grandparent application of U.S. Pat. No. 5,461,136. Other preferred compounds are described in examples 1–41 of U.S. Pat. No. 5,461,136.

For this invention, the terms "alkyl", "lower alkyl", "lower alkoxy", "lower alkylthio", "lower alkoxy carbonyl", "lower alkanoyl" and "lower alkanoyloxy", where used in U.S. Pat. No. 5,703,229 and herein; refer to an "alkyl" portion that represents 1–6 carbon atoms, which can be substituted by hydroxy, halogen, carboxy, cyano, alkoxy and aryl. "Cycloalkyl" represents 3–8 cyclic carbon atoms; "aryl" represents 6–18 aromatic carbon atoms; "heteroaryl" represents 2–17 cyclic carbon atoms with at least one oxygen, sulphur, nitrogen or a combination thereof, "alkenyl" and "alknyl" represent 3–8 carbon atoms with at least one double bond; "halogen" represents Br, Cl, F or I; "substituted carbamoyl" and "substituted sulfamoyl" represent $CONR_{12}R_{13}$ and $—SO_2NR_{12}R_{13}$, respectively, where $R_{12}$ and $R_{13}$ represent alkyl, alkenyl, alkynyl, cycloalkyl, aryl and heteroaryl, and "acyl" represents $R_{15}C(O)—O—$, wherein $R_{15}$ is alkyl.

The NIRF compounds selected for thermal papers should not cause premature reaction of the thermosensitive layer. Preferably, when the NIRF compound is shielded from ambient air to prevent reaction with oxygen, it is also shielded from reaction with the thermosensitive layer. Shielding can be accomplished by incorporating the NIRF compound in pigment particles, applying a protective coating on the layers formed with such compounds, or both.

The NIRF compounds are incorporated into thermal paper from coating formulations that comprise NIRF dyes (solution) and/or NIRF pigments (solids). The NIRF dyes comprise NIRF compounds in solution, preferably in aqueous solutions as discussed above. The NIRF pigment particles are solids and comprise a polymer or copolymer which is either admixed with NIRF compounds or the NIRF compounds are copolymerized with other active monomers, oligomers or polymers to form a copolymer, which is then added to a coating formulation.

The active monomers, oligomers or polymers typically have at least one reactive group selected from the formulae $$—OCOR_{14},\ —OCO_2R_{14},\ OCONHR_{14} \text{ or } —CO_2R_{14},$$

wherein $R_{14}$ is selected from unsubstituted or substituted alkyl, cycloalkyl or aryl radicals, $R_{14}$ preferably is unsubstituted alkyl, e.g., alkyl of up to about 8 carbons, or phenyl, and most preferably lower alkyl, e.g., methoyl and ethyl. The reactive group preferably is hydroxy, carboxy, carbomethoxy, carboethoxy or acetoxy. The monomers and oligomers contain 1 to about 8 reactive groups, preferably 2. The polymers may contain more. The NIRF compounds are added at such low levels that they do not significantly interfere with the polycondensation reaction of these active species.

The monomers, oligomers or polymers admixed with NIRF compounds or copolymerized therewith are preferably polyesters, polycarbonates or polyurethanes and are used in an amount sufficient to render the NIRF pigments waterproof. The diol components of the polyester may be comprised of, for example, ethylene glycol, 1,4-cyclohexanedimethanol, 1,2-propanediol, 1,3-propanediol, 2-methyl-, 1,3-propanediol, 1,6-hexanediol, 1,2-cyclohexanediol, 1,4-cyclohexanediol, 1,10-decanediol, 1,2-cyclohexanedimethanol, 1,3-cyclohexanedimethanol, X,8-bis-(hydroxymethyl)-tricyclo-[5.2. 1.0]-decane wherein X represents 3, 4, or 5; and diols containing one or more oxygen atoms in the chain, e.g., diethylene glycol, triethylene glycol, dipropylene glycol or tripropylene glycol and the like. In general, these diols contain 2 to 18, preferably 2 to 12 carbon atoms. Cycloaliphatic diols can be employed in their cis or trans configuration or as a mixture of both forms.

The acid component (aliphatic, alicyclic, or aromatic dicarboxylic acids) of the polyester may be comprised of, e.g., terephthalic acid, naphthalene-2,6-dicarboxylic acid, isophthalic acid, 1,4-cyclohexanedicarboxylic acid, 1,3-cyclohexane dicarboxylic acid, succinic acid, glutaric acid, adipic acid, sebacic acid, 1,2-dodecanedioic acid and the like. In place of the dicarboxylic acids themselves, it is possible and often preferable to use a functional acid derivative thereof such as the dimethyl, diethyl or dipropyl ester of the dicarboxylic acid. The anhydides of the dicarboxylic acids can likewise be employed. The polyesters can be produced using typical polycondensation techniques well known in the art. Polycarbonates useful in the practice of the invention are disclosed in *Kirk-Othmer Encyclopedia of Chemical Technology*, third edition, Vol. 18, pp. 479–494.

A NIRF pigment concentrate may be formed which comprises a NIRF compound of formula II, III or IV above, polymerized in a partially crystalline polyester at a level of from 0.1 to 30.0 wt. %, preferably 0.1 to about 10.0 wt. %. These copolymers preferably have at least two reactive groups. This concentrate can be used as a powder or pellet admixed with a desired polyester or other thermoplastic polymer. The concentrate may be dry blended or solution blended with additional resin. Suitable polyesters are linear thermoplastic crystalline or amorphous polymers.

A wide range of thermoplastic polymers suitable for blending with the above condensation polymers which contain the NIRF compounds are known in the art and includes polyesters, e.g., poly(ethylene terephthalate) and poly (butylene terephthalate); polyolefins, e.g., polypropylene, polyethylene, linear low density polyethylene, polybutylene and copolymers made from ethylene, propylene and/or butylene; polyamides, e.g., nylon 6 and nylon 66; polyvinyl chloride, polyvinylidene chloride; polycarbonates; cellulose esters, e.g., cellulose acetate, propionate, butyrate or mixed esters; polyacrylates, e.g., poly(methyl methacrylate); polyimides; polyester-amides; polystyrene; ABS (acrylonitrile-butadiene-styrene)type polymers, and (TPO) thermoplastic oligomers, etc.

The NIRF pigment particles may contain additional components to enhance or add to their performance. For example, fluorescent pigments and photochromic compounds which change color when exposed to UV light can be used.

The pigments may also contain additional resins or waxes, as well as UV stabilizers to enhance performance. The NIRF pigments may also be applied with a binder which binds the pigments to the surface of the base sheet. The binders may comprise resin, wax or a combination thereof. The binder employed will depend on the method of applying the sense mark, i.e., either ink jet, flexographic, electrostatic or thermal transfer printing. For flexographic printing, it is preferable that any binder used be water soluble, dispersible or emulsifiable. The amount of binder employed will also depend on the method used to deposit the NIRF pigment.

The binders may comprise a blend of resins to provide a specific property profile. The amount of thermoplastic resin can range from 15–35 wt. %, and preferably comprises at least 25 wt. % of the coating formulation, based on the total dry ingredients.

The coating formulations containing NIRF compounds as pigments can range widely in solids content such as from 20 to 100 wt. %, which includes the NIRF compound and the carrier polymer or copolymer components. The amount of carrier (water or solvent ) used can vary from 0 to 70 wt. % based on the total weight of the coating formulation containing the NIRF dye or pigment. The selection of binder compounds and carriers is also very broad. The composition of the coating formulation depends on the method used to incorporate the NIRF compound into the print medium. Where the NIRF compound is applied in the pattern of a scannable data image, the coating formulation may be adapted for ink jet printing methods (low solids content) or thermal transfer printing methods (high solids content). Conventional solvents for ink jet printing and conventional wax/polymer binders can be used for thermal transfer printing. Where the scannable data image is to be defined by a patterned mask formed by the thermosensitive coating over a uniform (unpatterned) coating of NIRF compound, this uniform coating can be applied by flexographic printing techniques where the NIRF compounds are incorporated in a flexographic ink. For flexographic printing, a solids content of from 40–60 wt. % is preferred for conventional flexographic printers such as those provided by Wolverine and Mark Andy. Pigment concentrates are often prepared and diluted with polymer resin to achieve preferred levels of NIRF compounds.

The concentration of the NIRF compound within the coating formulations used to form the thermal papers of this invention can vary over wide limits. In general, a scannable data image can be developed on most thermal papers with a NIRF compound present within the coating formulation in an amount as low as 0.1 ppm based on the total weight of solids (dry components). It is generally desirable that the NIRF compound be present at the lowest practical level needed to produce an image which differentiates the fluorescence of the thermal paper sufficiently such that the boundaries of the image can be detected to avoid interference from other colors and to minimize costs. Typically, the amount of NIRF compound within the coating formulation used falls within the range of 0.5 ppm to 1000 ppm, based on dry components. Preferred amounts fall within the range of 0.5 ppm to 300 ppm, with amounts of 1 ppm to 100 ppm often being most preferred to ensure contrast between a variety of thermal papers at minimum cost.

The coating formulations may contain additives such as wax and resin binders discussed below, as well as pH stabilizers, UV stabilizers, surfactants, colored pigments, defoamers and plasticizers. The nature of these additives will depend on the end use.

The coating formulations containing NIRF dyes or NIRF pigments preferably comprise an aqueous based carrier when used on thermal paper so as not to pre-activate the thermosensitive layer. The carrier can comprise an aqueous solution with or without a water soluble, dispersible or emulsifiable organic solvent which does not activate the thermal paper. The aqueous based carrier may contain a dispersing agent to help solubilize the NIRF pigment or dye within the security ink. The coating formulation is preferably dried on the thermal paper by the evaporation of water and any other volatile components within the aqueous based carrier to leave a solid layer.

The water based coating formulations used on the thermal papers of this invention may comprise a water emulsifiable or dispersible wax and/or a water soluble, emulsifiable or dispersible thermoplastic resin binder component. The waxes can be natural waxes, including Carnauba wax, candelilla wax, beeswax, rice bran wax, petroleum waxes such as paraffin wax, synthetic hydrocarbon waxes such as low molecular weight polyethylene and Fisher-Tropsch wax, higher fatty acids such as myristic acid, palmitic acid, stearic acid and behenic acid; higher aliphatic alcohols such as steryl alcohol and esters such as sucrose fatty acid esters. Mixtures of waxes can also be used. To aid in the dispersion of the wax within an aqueous medium, micronized grades of wax are preferred.

Water soluble, dispersible or emulsifiable resins suitable as binders include thermoplastic resins such as polyvinyl chloride, polyvinyl acetate, vinyl chloride-vinyl acetate copolymers, polyethylene, polypropylene, polyacetal, ethylene-vinyl acetate copolymer, ethylenealkyl(meth) acrylate copolymer, ethylene-ethylacetate copolymer, polystyrene, styrene copolymers, polyamide, ethylcellulose, epoxy resin, polyketone resin, polyurethane resin, polyvinylbutryl, styrenebutadiene rubber, nitrile rubber, acrylic rubber, ethylene-propylene rubber, ethylene alkyl (meth)acrylate copolymer, styrene-alkyl(meth)acrylate copolymer, acrylic acid-ethylene-vinylacetate terpolymer, saturated polyesters and sucrose benzoate. To obtain emulsions of polymers which are insoluble or partially soluble in water, the resin is typically ground to submicron size.

Thermal papers which contain a near infrared radiation scannable data image can be prepared with formulations containing NIRF compounds using conventional printing/coating equipment and techniques. Examples include those of ink jet printing, thermal transfer printing, electrostatic printing, relief printing, offset printing, flexography, lithography and silkscreening. Ink jet printing is preferred where the NIRF compound is to be applied in the pattern of a scannable data image. Flexographic printing equipment is preferred where a uniform coating of NIRF compound is to be applied on the thermal paper and subsequently masked with a an activated thermosensitive layer which absorbs near infrared radiation. Where the coating formulation is applied to a base sheet of a thermal paper, the printing or coating operation/procedure is not limited by temperature. Where the coating formulation is deposited on the thermosensitive coating or a top coating thereon, only methods which do not require the application of high temperatures can be used. Once the coating formulation is applied to the thermosensitive coating or top coating, it is dried at temperatures preferably less than 65° C., most preferably at ambient temperature.

In preferred methods, NIRF pigments are used within a coating formulation that is applied to the base substrate and overcoated with the base coating and/or thermosensitive layer of the thermal paper. Where this coating formulation is applied to the back side of the thermal paper, the NIRF coating is overcoated with a protective water-proof coating. Such a protective coating may also be applied to coating formulations deposited on the front side of the thermal paper, either before or after application of the thermosensitive layer.

An alternative embodiment is to incorporate the NIRF compound in the coating formulation for the thermosensitive coating. The coating formulation for the thermosensitive layer with NIRF compounds incorporated therein can be applied to the base sheet with conventional equipment and printing methods.

To provide the NIRF coating formulation, the components are typically combined as dispersions at about 30 wt. % solids in a ball mill or similar conventional grinding equipment, agitated and ground. Where a wax emulsion is used, it is typically the initial material and the remaining components are added thereto with minor heating.

The NIRF compounds on the thermal papers must be stable to be effective in providing a scannable image. Preferably, the NIRF compounds remain sufficiently stable so as to be sensed by a detector at least 60 days from manufacture. Preferably, the NIRF compounds remain stable for one year or more. It is also preferable that the near infrared radiation scannable data image remain transparent to the naked human eye under illumination with a 60 watt incandescent light bulb. The near infrared radiation scannable data image on the thermal papers claimed herein may contain an additional sensible material selected form the group consisting of colored dyes, and pigments which do not absorb near infrared radiation such as fluorescent dyes, fluorescent pigments, photochromic dyes and photochromic pigments which absorb and reflect light upon exposure to UV light.

Thermally imaging a bar code over a uniform coating of NIRF compounds forms a reverse near infrared bar code image since the activated inks absorb near infrared radiation. The bar code image is scannable using conventional visible light bar code readers. The bar code can be validated by reading the reverse image with a near infrared scanner. Alternatively, the reverse bar code can be thermally imaged and the bar code can be scanned by a near infrared bar code reader. The reverse thermal image cannot be scanned such that the data encoded by the NIRF compounds is secured from fraudulent duplication where the NIRF compounds are unavailable.

Thermal papers with overlapping bar codes can be prepared by printing two or more near infrared radiation scannable bar code images on the thermal paper wherein each bar code is responsive to different wave lengths in the range of 670 nm to 2,500 nm. These overlapping bar codes allow for the incorporation of additional information in the same region when read at two distinct wavelengths.

Apparatus used to detect the NIRF compounds and read the scannable data image include any apparatus capable of detecting fluorescence, i.e., photons emitted by dyes and pigments at wavelengths in the range of about 670 nm to 2,500 nm. These photon detectors include photomultiplier tubes, solid state detectors, semiconductor based detectors and similar devices. Silicon photodiodes or germanium detectors are specific examples of suitable photon detectors. Filters may be used to restrict the wavelengths which impinge the detector.

Devices which irradiate the NIRF compounds with near infrared radiation include laser diodes, light emitting diodes, solid state lasers, dye lasers, incandescent light sources and other light sources which emit radiation at a wavelength in the range of 670–2500 nm. Preferred light sources are those which have a maximum signal at the maximum of the absorbency of the NIRF compound. Filters may be used to restrict the wavelengths which irradiate the NIRF compounds.

Without further elaboration, it is believed that one skilled in the art can, using the preceding description, utilize the present invention to its fullest extent. The entire disclosure of all applications, patents, publications, cited above and below, are herein incorporated by reference.

EXAMPLES

Example 1

Preparation of Concentrate

A NIRF pigment concentrate was prepared by dispersing Eastek 1100 polyester, available from Eastman Chemical, with 2000 ppm NIRF 670 in its backbone in deionized water at a concentration of 30 wt. % solids. The concentrate comprises 600 ppm NIRF 670 dye compound.

Coating formulations were prepared using the 600 ppm concentrate of NIRF 670 dye compound and the flexo-overprint varnish —X24561-115C, 75/25 of Eastek 1100/1300, as a diluent. Coating formulations with 30, 60 and 120 ppm concentrations of NIRF 670 were prepared. The viscosity of the coating formulations was about 19 seconds of Zahn cup No. 2.

Printing on Thermal Paper

Samples of thermal paper, Konzaki F-380, having a thermosensitive coating thereon, are printed with a Mark Andy 830 flexographic press from coating formulations under the following eight different conditions:

1. print 60 ppm ink on the front side of thermal paper without using heat drying;
2. print 60 ppm ink on the back side of thermal paper with heat drying;
3. print 60 ppm ink on the front side of thermal paper with heat drying;
4. print 30 ppm ink on the back side of thermal paper with heat drying;
5. print 120 ppm ink on the back side of thermal paper with heat drying;
6. print 30 ppm ink on the front side of thermal paper with heat drying;
7. print 120 ppm ink on the front side of thermal paper with heat drying.

A rubber metering roll is used to supply and meter the coating formulations into an Anilox roll from which the coating formulation is transferred to the substrate through a plate. The Anilox roll comprises 200 pyramids with a volume of 7 BCM. The line speed is 250 ft/min. Drying without heat is accomplished by exposure to air without blowing air. Drying with heat is accomplished using a Quartz lamp as a heat source with blowing air at a temperature of about 110° F. in the dryer zone.

Thermal Printing

The thermal paper is activated to form a reverse bar code with rectangles 1" in length and a width ranging from ⅛" to ½".

Sensing Test

The prints are tested for detection of the NIRF pigments using a Meter Model DM-8 detector by V.C. Engineering Inc. of Cincinnati, Ohio. The NIRF compounds were detected on all prints in the region of the reverse bar code. The detector sends signals to a logic element programmed to read the bar code. The heat drying process produced papers with stronger signals, as observed using a Sony CCD camera. However, the heat drying seems to reduce the amount of NIRF compound penetrating the pores of paper.

Example 2

Coating formulations of NIRF T4 780 at concentrations of 300 and 600 ppm are prepared using 3000 ppm and 6000 ppm NIRF concentration polymers, respectively. The NIRF T4 pigments are dispersed into acrylic overprint varnish and the solids adjusted to 44% in water. The viscosity of both coating formulations is 23 seconds in a Zahn Cup #2 (X24429-187 and X24429-188B).

Printing on Thermal Paper

The two coating formulations are used to print bar codes on rolls of Kanzaki F-380 thermal paper and No. 15 bond paper, respectively, using a Mark Andy 830 Flexo press. A rubber metering roll is used to supply and meter ink to an Anilox roll, from which the ink is transferred to a rubber plate. The Anilox roll comprises ceramic 300 lines (10 BCM) and 400 lines (7 BCM) Anilox rolls, respectively. The line speed is 100 feet per minute and drying is accomplished employing a quartz lamp as a heat source. The NIRF compound is detected on the papers after the press run with the detector described in Example 1. The detector sends signals to a logic element programmed to read the scannable data image.

Example 3

Coating formulations described in Examples 1 and 2 (NIRF 670 and NIRF T4 780) are coated on various types of paper, both front and back with the Marc Andy Flexo press discussed above with an Anilox roller 300 with 10 BCM rollers. The coating formulations are printed on the following papers at a press speed of 200 feet per minute, as 1 " wide bar codes traveling with the web.

1. 3-S tablet
2. T-1012A and
3. Enviro 100,

The NIRF compounds on each paper were sensed after printing using the detector described in Example 1.

Example 4

Two sets of five colors bars (¾" tall and 13" wide) are applied to the various papers of Example 3, as set forth below.

| | | |
|---|---|---|
| Set #1 | 1. | Pantone Green |
| | 2. | Pantone Black |
| | 3. | Pantone Cyan |
| | 4. | Pantone Violet |
| | 5. | PMS 348 |
| Set #2 | 1. | Reflex Blue |
| | 2. | PMS 185 |
| | 3. | PMS 347 |
| | 4. | PMS 469 |
| | 5. | PMS 165 |

The coating formulations described in Examples 1 and 2 (Groups 1 and 2) are applied as bar codes as shown in Table A. NIRF compound is detected in each after printing and the encoded information is read.

| NIRF Position | Paper | Color Group |
|---|---|---|
| 1. Front | 3-S | 1 |
| 2. Back | 3-S | 1 |
| 3. Front | T-1012 | 1 |
| 4. Back | T-1012 | 1 |
| 5. Back | E-100 | 1 |
| 6. Front | E-100 | 1 |
| 7. Back | 3-S | 2 |
| 8. Front | 3-S | 2 |
| 9. Back | T-1012 | 2 |
| 10. Back | T-1012 | 2 |
| 11. Front | E-100 | 2 |
| 12. Back | E-100 | 2 |

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A thermal paper with at least one near infrared radiation scannable data image comprised of a near infrared fluorescent (NIRF) compound positioned thereon.

2. A thermal paper with at least one near infrared radiation scannable data image positioned thereon, wherein said near infrared radiation scannable data image comprises a near infrared-fluorescent (NIRF) compound which reflects near infrared radiation in the range of from 670 nm to 2,500 nm and a polymer resin which limits contact of the near infrared-fluorescent compound with air.

3. A thermal paper as in claim 2 wherein said near infrared radiation scannable data image comprises a patterned layer and the concentration of the NIRF compound in said near infrared radiation scannable data image is sufficiently high to contrast the reflectance of near infrared radiation by the near infrared radiation scannable data image from the reflectance of near infrared radiation by the thermal paper background so as to provide a voltage by a photon detector operating in the near infrared region of 670 nm to 2,500 nm for the scannable data image which is at least 0.1 volts greater than the voltage for the thermal paper background.

4. A thermal paper as in claim 3 wherein the scannable data image comprises a patterned layer of segments having an area in the range of 0.125 $inch^2$ to 1.0 $inch^2$.

5. A thermal paper as in claim 4, wherein the patterned layer of segments comprises 0.5 to 1000 ppm NIRF compounds, based on total solids.

6. A thermal paper as in claim 3, wherein the NIRF compound is sufficiently stable in air so as to be sensed by said detector over 60 days after the near infrared radiation scannable data image is positioned on the base sheet.

7. A thermal paper as in claim 2 wherein said near infrared radiation scannable data image comprises a patterned layer positioned on said thermal paper and the concentration of the NIRF compounds in the patterned layer ranges from 0.5 to 1000 ppm, based on total solids within said patterned layer.

8. A thermal paper as in claim 7, wherein the near infrared radiation scannable data image is a bar code.

9. A thermal paper as in claim 1, wherein the near infrared radiation scannable image is transparent to the naked human eye under illumination with a 60 watt incandescent light bulb.

10. A thermal paper as in claim 1, wherein the near infrared fluorescent (NIRF) compound absorbs and reflects light in the range of 780 nm to 2500 nm.

11. A thermal paper with at least one near infrared radiation scannable data image positioned thereon which comprises a near infrared flourescent (NIRF) compound which reflects near infrared radiation in the range of from 670 nm to 2500 nm and a polymer resin which limits contact of the near infrared-flourescent compound with air, wherein the near infrared scannable image further comprises a uniform coating of NIRF compounds positioned on the thermal paper and a mask positioned over the uniform coating of NIRF compounds, wherein said mask comprises activated portions of the thermosensitive coating which absorbs near infrared radiation in the range of 670 nm to 2500 nm and which is of a pattern that defines said near infrared radiation scannable data image through exposed portions of the uniform coating of NIRF compounds.

12. A thermal paper as in claim 11 wherein the mask provides exposed portions of the uniform coating of NIRF compounds with an area in the range of 0.125 $in^2$ to 1.0 $in^2$ and wherein the concentration of the NIRF compound in said uniform coating is sufficiently high to contrast the reflectance of near infrared radiation by the uniform coating of NIRF compound from that of the mask so as to provide a voltage by a photon detector operating in the near infrared region of 670 nm to 2,500 nm for the exposed uniform coating of NIRF compounds which is at least 0.1 volts greater than the voltage for the mask.

13. A thermal paper as in claim 11 wherein the mask provides exposed portions of the uniform coating of NIRF compounds with an area in the range of 0.125 $in^2$ to 1.0 $in^2$ and wherein the concentration of the NIRF compounds in said uniform coating ranges from 0.5 to 1000 ppm, based on the total solids within said uniform coating.

14. A thermal paper which comprises a base substrate, a base coating, a thermosensitive coating positioned on said base coating and at least one near infrared radiation scannable data image positioned on:

a) said base coating, b) said thermosensitive coating, c) an optional top coating, d) an optional back coating, e) said base substrate; or f) a combination of a), b), c), d) and e);

said near infrared radiation scannable data image comprising a patterned layer that contains a near infrared fluorescent (NIRF) compound which reflects radiation in the range of 670 nm to 2,500 nm and a polymer resin which limits contact of the NIRF compound with air.

15. A thermal paper which comprises a base substrate, a base coating, a thermosensitive coating positioned on said base coating, a near infrared fluorescent compound uniformly incorporated in:

a) said base coating, b) said thermosensitive coating, c) an optional top coating, d) an optional back coating, e) said base substrate; or f) a combination of a), b), c), d) and e);

and a patterned mask in a pattern reverse of a scannable data image comprised of activated portions of the thermosensitive layer such that the unactivated portions of the thermosensitive layer are in the form of a scannable data image.

16. A thermal paper as in claim 15 where the amount of NIRF compound in the coating or base substrate which contains the NIRF compound falls within the range of 0.5 ppm to 300 ppm, based on the total weight of solids in the coating or base substrate which contains the NIRF compound.

17. A thermal paper as in claim 15, wherein the NIRF compound is incorporated in the thermosensitive coating.

18. A thermal paper with overlapping bar codes wherein each of the overlapping bar codes is a near infrared radiation scannable bar code comprised of a different near infrared fluorescent compound that reflects near infrared radiation at a different wave length within the range of 670 nm to 2,500 nm.

19. A method for preparing a thermal paper with a near infrared radiation scannable bar code which comprises:

a) forming a uniform layer of NIRF compounds on said thermal paper, wherein the amount of said NIRF compounds in the uniform layer is sufficient to be sensed by a photon detector operating in the near infrared region of 670 to 2,500 nm; and b) thermally activating the thermosensitive coating of the thermal paper in the pattern of a reverse bar code; said activated thermosensitive coating comprising a near infrared radiation absorbing dye which absorbs near infrared radiation in the range of 670 nm to 2500 nm.

* * * * *